US010443186B2

(12) United States Patent
Wong et al.

(10) Patent No.: US 10,443,186 B2
(45) Date of Patent: Oct. 15, 2019

(54) STEAM IRON

(71) Applicant: KONINKLIJKE PHILIPS N.V., Eindhoven (NL)

(72) Inventors: William Wai Lik Wong, Eindhoven (NL); Mohankumar Valiyambath Krishnan, Eindhoven (NL); Luck Wee Png, Eindhoven (NL); Linfang Xu, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 20 days.

(21) Appl. No.: 15/882,306

(22) Filed: Jan. 29, 2018

(65) Prior Publication Data

US 2018/0163341 A1 Jun. 14, 2018

Related U.S. Application Data

(63) Continuation of application No. 15/325,755, filed as application No. PCT/EP2015/068402 on Aug. 26, 2015, now Pat. No. 9,879,375.

(30) Foreign Application Priority Data

Aug. 26, 2014 (EP) ..... 14182186

(51) Int. Cl.
*D06F 75/24* (2006.01)
*D06F 75/16* (2006.01)

(52) U.S. Cl.
CPC ..... *D06F 75/24* (2013.01); *D06F 75/16* (2013.01)

(58) Field of Classification Search
CPC ..... D06F 75/00–38; F22B 1/28; F22B 1/284; F22B 1/285; F22B 35/00
See application file for complete search history.

(56) References Cited

U.S. PATENT DOCUMENTS 2,179,259 A 11/1939 Lester
2,419,705 A * 4/1947 Busch ..... D06F 75/16 38/77.8

(Continued)

FOREIGN PATENT DOCUMENTS

CN 201183911 1/2009
CN 202116906 U 1/2012

(Continued)

OTHER PUBLICATIONS

Wikipedia, "Wikipedia article on heat conduction" Jun. 26, 2014, [cited Apr. 10, 2019].

*Primary Examiner* — Ismael Izaguirre

(57) ABSTRACT

A steam iron (10) comprises a steam generator (15) having a main body portion (15*a*) including an electrical heating element (16) to heat the steam generator (15), and an ironing plate (13) coupled to the steam generator (15) via a thermal coupling and configured to be passively heated by conduction of heat from the steam generator (15) via the thermal coupling. The thermal coupling between the steam generator (15) and the ironing plate (13) comprises an indirect thermal path formed by a flange (22) of the steam generator (15), the flange (22) being in contact with the ironing plate (13) and being spaced from the main body portion (15*a*) of the steam generator (15), the flange (22) also being configured to space the main body portion (15*a*) of the steam generator (15) from the ironing plate (13) to restrict the conduction of heat from the main body portion (15*a*) of the steam generator (15) to the ironing plate (13).

20 Claims, 6 Drawing Sheets

(56) References Cited

U.S. PATENT DOCUMENTS

| | | | | | |
|---|---|---|---|---|---|
| 2,871,589 | A | | 2/1959 | Schwaneke | |
| 2,880,530 | A | | 4/1959 | Schwaneke | |
| 2,928,194 | A | | 3/1960 | Maykemper | |
| 3,110,975 | A | * | 11/1963 | Kircher | D06F 75/18 38/77.7 |
| 3,930,325 | A | | 1/1976 | Schaeffer | |
| 3,942,706 | A | * | 3/1976 | Schaeffer | D06F 75/18 228/164 |
| 4,196,340 | A | | 4/1980 | Evans | |
| 4,352,252 | A | * | 10/1982 | Brenot | F22B 1/288 122/39 |
| 4,586,278 | A | * | 5/1986 | Cavalli | D06F 75/18 38/77.81 |
| 4,837,952 | A | | 6/1989 | Hennuy | |
| 5,279,054 | A | * | 1/1994 | Chasen | D06F 75/24 219/254 |
| 5,613,309 | A | | 3/1997 | Amsel | |
| 5,780,812 | A | | 7/1998 | Klinkenberg | |
| 5,883,358 | A | | 3/1999 | Brandolini | |
| 5,937,552 | A | | 8/1999 | Hall | |
| 6,125,562 | A | * | 10/2000 | Dodier | D06F 75/38 38/93 |
| 6,992,267 | B2 | * | 1/2006 | Wang | D06F 75/18 219/245 |
| 7,562,474 | B2 | | 7/2009 | Voitchovsky | |
| 9,879,375 | B2 | * | 1/2018 | Wong | D06F 75/24 |
| 2004/0181979 | A1 | | 9/2004 | Compeau | |
| 2007/0289174 | A1 | | 12/2007 | Yu | |
| 2008/0040954 | A1 | | 2/2008 | Yu | |
| 2008/0196282 | A1 | | 8/2008 | Jiang | |
| 2013/0327759 | A1 | | 12/2013 | Otsuka | |

FOREIGN PATENT DOCUMENTS

| | | | |
|---|---|---|---|
| DE | 102012219292 | | 3/2014 |
| EP | 0651086 | A1 | 5/1995 |
| EP | 2757190 | | 7/2014 |
| FR | 2566439 | A1 | 12/1985 |
| GB | 2016052 | A | 9/1979 |
| JP | 2743619 | | 4/1998 |
| JP | 2975655 | | 11/1999 |
| JP | 2000107498 | | 4/2000 |
| WO | 2007062986 | A1 | 6/2007 |
| WO | 2010081962 | A1 | 7/2010 |
| WO | 2011/080026 | | 7/2011 |
| WO | 2012/085746 | | 6/2012 |
| WO | 2014106793 | A1 | 7/2014 |
| WO | 2016/024190 | | 2/2016 |

* cited by examiner

STEAM IRON

CROSS-REFERENCE TO RELATED APPLICATION

The present application is a continuation of co-pending U.S. patent application Ser. No. 15/325,755, filed Jan. 12, 2017, which is the U.S. National Phase application under 35 U.S.C. § 371 of International Application No. PCT/EP2015/068402, filed on Aug. 11, 2015, which claims the benefit of International Application No. 14182186.8 filed on Aug. 26, 2014. These applications are hereby incorporated by reference herein.

FIELD OF THE INVENTION

The present invention relates to steam irons and, in particular, to steam irons with improved heat transfer and temperature control properties.

BACKGROUND OF THE INVENTION

Steam irons are known that include a steam generator and an ironing plate coupled to the steam generator and which contacts the garments to be ironed. Steam generated in the steam generator is expelled onto the garments through holes in the ironing plate. Such irons contain control electronics to control the operation of the steam generator within an optimum temperature range. The ironing plate is passively heated by conduction of heat from the steam generator at the areas of contact between the steam generator and the ironing plate. The control electronics maintain the operation of the steam generator and the thermally coupled ironing plate, within an optimum temperature range.

Steam generators in such known steam irons include a high power heating element which can cause a relatively large temperature overshoot in the steam generator. In certain circumstances, where a temperature overshoot occurs and the iron is left unused for a period of time, the thermal energy in the steam generator can cause the ironing plate to heat up to a temperature towards or even over the upper limit of the optimum temperature range. Such overheating can also create hot spots in the ironing plate proximate the areas where the steam generator is coupled to the ironing plate.

SUMMARY OF THE INVENTION

It is an object of the invention to provide a steam iron which substantially alleviates or overcomes the problems mentioned above.

According to the present invention, there is provided a steam iron comprising a steam generator comprising a main body portion including an electrical heating element to heat the steam generator, an ironing plate coupled via a thermal coupling to the steam generator and configured to be passively heated by conduction of heat from the steam generator via the thermal coupling, wherein the thermal coupling between the steam generator and the ironing plate comprises an indirect thermal path formed by a flange of the steam generator, the flange being in contact with the ironing plate and being spaced from the main body portion of the steam generator, the flange also being configured to space the main body portion of the steam generator from the ironing plate to restrict the conduction of heat from the main body portion of the steam generator to the ironing plate.

This advantageously avoids excessive heating of the steam generator from causing corresponding heat spikes on the ironing plate. The configuration also means that heat from the main body of the steam generator has to be conducted through a convoluted path to reach the ironing plate.

The flange may comprises a first portion extending in a first direction from the main body portion of the steam generator, and a second portion extending from the first portion such that a gap is defined between the main body portion of the steam generator and the second portion of the flange.

This configuration flange aids the restriction of the thermal path, and also helps separate the main body of the steam generator from the flange/thermal path, and the ironing plate. The flange may be between 1-3 mm thick. This provides a preferred thermal restriction performance.

The width of the flange at the contact point between the flange and the ironing plate may be between 1-3 mm over at least 50% of the contact area. The exact width of the flange may be different at different points around the steam generator, and the average width of the flange may be between 1-3 mm. In particular, the average width of the flange at the contact point at the ironing plate may be between 1-3 mm.

The steam generator may be exclusively coupled to the ironing plate by the flange and the remainder of the steam generator may be spaced from the ironing plate. Alternatively, the steam generator may be primarily coupled to the ironing plate by the flange and the remainder of the steam generator may be spaced from the ironing plate over at least 75% of the adjacent surface of the steam generator. This advantageously ensures the primary heat transfer path between the steam generator and the ironing plate is via the flange and little can be transmitted to the ironing plate via any other path.

The ratio of the mass of the steam generator to the mass of the ironing plate may be between 1:1 and 1.5:1. This is a preferred optimum ratio for thermal inertia between the steam generator and the ironing plate, to ensure quicker heating of the steam generator, and less temperature fluctuations of the ironing plate.

The ironing plate may comprise an area of increased thickness in the region where the flange contacts the ironing plate to enhance thermal distribution of conducted heat from the flange through the ironing plate. This advantageously avoids hot spots on the ironing plate adjacent contact points with the steam generator.

The steam iron may further comprise a controller to control operation of the steam iron, wherein the controller is configured to perform a first heating operation upon initial heating of the steam iron, and perform a second heating operation during subsequent operation of the steam iron, wherein the first heating operation comprises heating the steam generator to a higher temperature range than with the second heating operation. This enables the ironing plate to reach operational temperature quicker despite the restricted thermal path between the steam generator and the ironing plate.

The first heating operation may comprise heating the steam generator to remain above a first minimum predetermined temperature, and the second heating operation comprises heating the steam generator to remain above a second minimum predetermined temperature, wherein the first minimum temperature is higher than the second minimum temperature.

During the second heating operation the steam generator may be maintained at a temperature between 140 and 200 degrees Celsius. The temperature is preferably maintained at or around 165 degrees Celsius.

The controller may be configured to perform the first heating operation until the ironing plate reaches a predetermined minimum operating temperature. The minimum operating temperature may be 100 degrees Celsius. This minimum temperature helps avoid performance problems arising from condensation of steam generated.

The controller may be configured to control the temperature of the steam generator such that the temperature of the ironing plate is maintained between 100 degrees Celsius and 145 degrees Celsius.

The steam iron may further comprise at least one of a motion sensor and an orientation sensor connected to the controller, and the controller is configured to control the heating of the steam generator in dependence upon at least one parameter of ironing direction, speed and iron orientation as detected by the at least one sensor. This enables the steam iron to be controlled appropriately according to use of the iron, to avoid overheating when not used and/or underheating during sustained use.

The controller may be configured to control operation of the steam generator such that if the temperature of the steam generator falls below a first predetermined value, then the controller sets a steam generator heater switch OFF value for an initial heating cycle of the steam iron to a second predetermined value, whereas during subsequent ironing operation the steam generator is operated at a third predetermined temperature value, the third predetermined temperature value being higher than the first predetermined temperature value and lower than the second predetermined temperature value. This advantageously enables the ironing plate to be brought rapidly back to an operational temperature in the event the steam generator falls below a minimum temperature threshold, for example if the iron is turned off and restarted shortly thereafter. The temperature of the steam generator may be measured as the temperature of the main body portion of the steam generator.

In various embodiments, the flange of the steam generator may be integral with both steam generator and ironing plate to form a single piece, e.g. in the case of one casting.

It may be envisioned that the flange is part of the ironing plate instead of the steam generator. In other words, the flange extends from the ironing plate. The thermal coupling between the steam generator and the ironing plate may include an indirect thermal path formed by the flange of the ironing plate, the flange being in contact with the steam generator and being spaced from the main body portion of the steam generator, the flange being configured to space the main body portion of the steam generator from the ironing plate to restrict the conduction of heat from the main body portion of the steam generator to the ironing plate.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
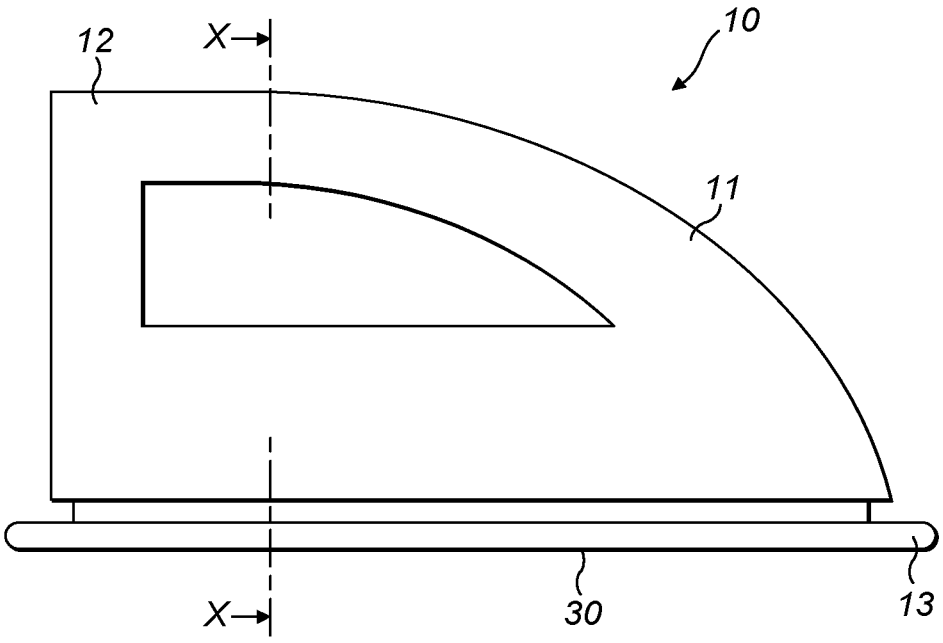
FIG. 1 shows a schematic view of a steam iron of a first embodiment of the invention.
Figure 2:
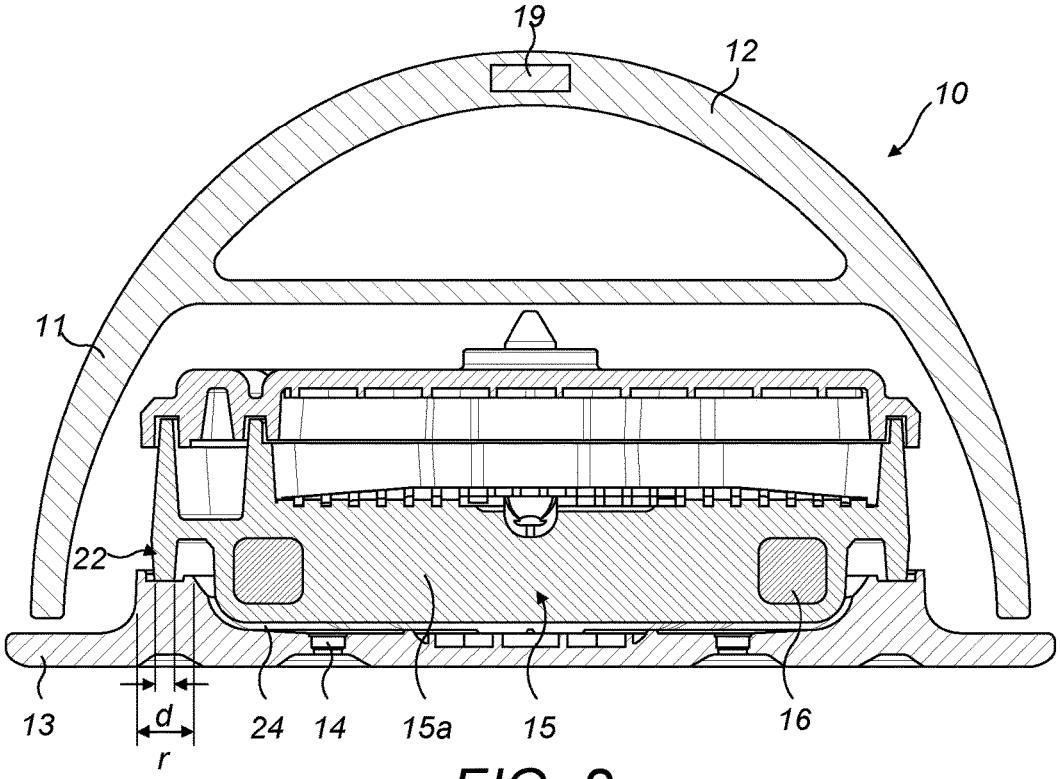
FIG. 2 shows a cross-sectional view along the line X-X of the steam iron shown in FIG. 1.
Figure 3:
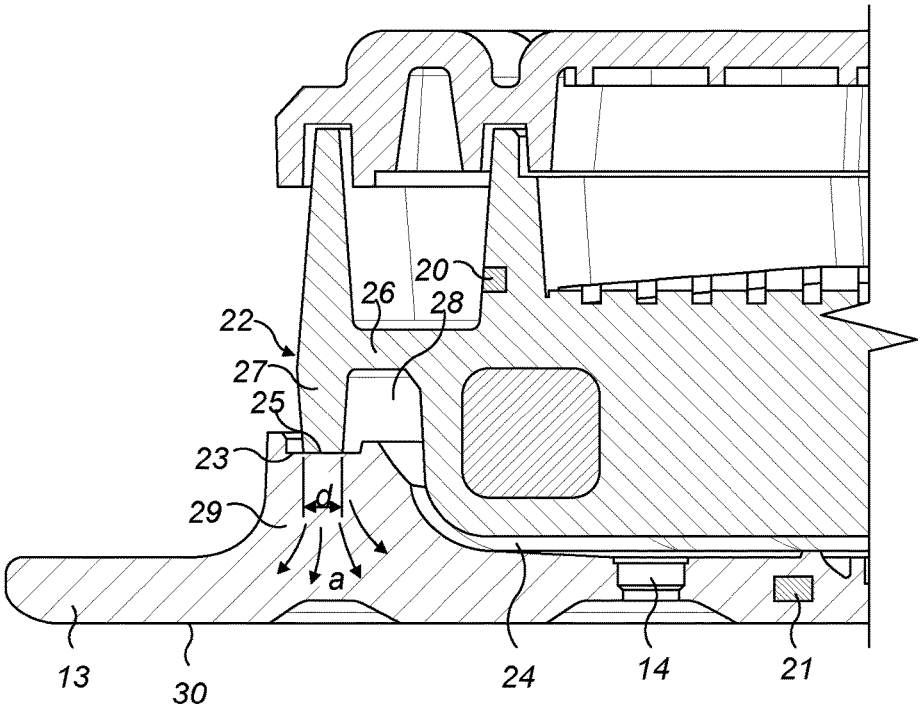
FIG. 3 shows an enlarged view of the circled portion of the steam iron shown in FIG. 2.

Referring now to FIGS. 1 to 3, a steam iron 10 according to a first embodiment of the invention is shown and comprises a housing 11 including a handle 12 and a heated ironing plate 13 which, in use, contacts garments being ironed. The ironing plate 13 includes a plurality of steam holes 14 through which steam can be expelled onto a garment being ironed.

The steam iron 10 comprises a steam generator 15 within the housing 11 which has an internal electrical heating element 16 that heats the body of the steam generator 15. The steam iron 10 also includes a water reservoir (not shown) with a water supply pipe (not shown) configured to provide water to the steam generator 15 to be converted to steam. The steam iron 10 is configured such that steam generated by the steam generator 15 can be expelled through the steam holes 14 in the ironing plate 13.

The steam iron 10 includes a water transfer mechanism to supply water from the reservoir to the steam generator. In the exemplary embodiment the water transfer mechanism comprises an electrical pump (not shown) controlled by a user. However, this may alternatively comprise a manually operated mechanical pumping mechanism without an electrical pump.

A controller 18 (FIG. 8) is connected to the heating element 16 and to a number of sensors on the steam iron to enable it to control the operation of the steam iron. The steam iron includes a motion/orientation sensor 19, which may comprise a ball sensor or accelerometer, connected to the controller 18. This can be used to determine whether the steam iron 10 is in use or not, by detecting whether the steam iron 10 is moving or is stationary, and/or the tilt angle of the steam iron 10 to determine whether the steam iron 10 is in the upright rest position or horizontal operative position. Signals from these sensor(s) can then be used to control operation of the heating element 16 of the steam generator 15. For example, the heating element 16 may be controlled to a set temperature of the steam generator if the steam iron 10 is in use or in the operative position, and the heating element 16 may be controlled to a different set temperature of the steam generator or switched off when, or a predetermined time period after, it is detected that the steam iron 10 is not in use or is in the upright rest position.

The steam generator 15 also includes a thermistor 20 which is connected to the controller 18 and is configured to detect a temperature of the steam generator 15 and provide a signal dependent on the detected temperature to the controller 18. Optionally, the ironing plate 13 may include an additional thermistor 21 connected to the controller 18 to detect the temperature of the ironing plate 13 and provide a signal dependent on the ironing plate temperature to the controller 18.

The ironing plate 13 is passively heated by heat transfer from the steam generator 15. The steam generator 15 comprises a main body portion 15*a* and a contact flange 22 which extends from a peripheral edge of the main body portion 15*a*. The heating elements 16 are provided within the main body portion 15*a*. The steam generator 15 is disposed on the ironing plate 13 and is in contact with the ironing plate 13 by means of the contact flange 22 around the perimeter of the main body 15*a* of the steam generator 15 and which sits in a recess 23 formed around the ironing plate 13. A sealing means (not shown) may be provided in or around the recess 23 to prevent steam leakage. The main body of the steam generator 15 is spaced from the ironing plate 13 almost at all points except the contact flange 22, and is thereby a substantially suspended thermal mass configuration. In particular, across the central portion of the main body portion 15*a* of the steam generator 15, an air gap 24 is provided between the steam generator 15 and the ironing plate 13. The heat from the main body portion 15*a* of the steam generator 15 is primarily transferred to the ironing plate 13 by conduction through the contact flange 22, with only a small proportion transferring to the ironing plate 13 by radiation or conduction/convection across the air gap 24 in areas other than the contact flange 22. That is, the primary thermal coupling between the steam generator 15 and the ironing plate 13 is the contact flange 22. The steam holes 14 in the ironing plate 13 are in fluid communication with the air gap 24 and, in use, the steam generator 15 provides steam into the air gap 24 which is then expelled out of the steam iron 10 through the steam holes 14.

It can be seen from the cross-sectional views of FIG. 2, and in particular FIG. 3, that the contact flange 22 around the edge of the steam generator 15 is narrow with a narrow contact foot 25 where it contacts the ironing plate 13, as shown by dimension "d". The contact flange 22 also provides a relatively long and narrow heat path between the main body portion 15*a* of the steam generator 15 and the ironing plate 13. This heat path comprises a first fin 26 extending horizontally from the main body portion 15*a* of the steam generator 15, and a second fin 27 extending vertically from the first fin 26, the contact foot 25 being disposed at the remote end of the second fin 27. This configuration provides an air space 28 between the main thermal mass of the steam generator 15, namely the main body portion 15*a*, and the contact foot 25. The contact flange 22 includes a vertical portion, namely the second fin 27, which is spaced from the horizontally adjacent portion of the main body portion 15*a* of the steam generator 15. The first and second fins 26, 27 thereby provide a restricted thermal path between the main thermal mass of the steam generator 15, that is, the main body portion 15*a* comprising the heating elements 16 and majority of the material mass of the steam generator 15, and the ironing plate 13. This configuration is such that the thermal path between the main body portion 15*a* of the steam generator 15 and the ironing plate 13 via the contact flange 22 is indirect, that is, the thermal path is non-linear and requires the transferred heat to follow the angled path through the contact flange 22 in a "goose-neck" type of shape. A non-linear thermal path may refer to a thermal path including a first thermal path component joined to a second thermal path component at an angle less than 180°. The first thermal path component and/or second thermal path component may for instance be linear, curved or angled. This restricted heat path configuration acts to prevent any large fluctuations in the temperature of the main body portion 15*a* steam generator 15 from causing large fluctuations in the ironing plate temperature, thereby acting as a thermal "damper" and allowing the ironing plate temperature to remain more consistent.

FIGS. 2 and 3 also illustrate that the recess 23 of the ironing plate 13 upon which the contact flange 22 sits is wider than the contact flange 22, shown by dimension "r" indicated in FIG. 2 being wider than dimensions "d". Also, the ironing plate 13 includes a large thermal distribution area 29 having a relatively large mass of material between the recess 23 and the base surface 30 of the ironing plate 13. The ironing plate 13 is thicker in the region of the thermal distribution area 29 than over the rest of the width of the ironing plate 13. As such, the point at which the steam generator 15 contacts the ironing plate 13 is spaced further from the ironing surface 30 of the ironing plate 13 than the majority of the remainder of the opposite side of the ironing plate 13 is spaced from the ironing surface 30. The large thermal distribution area 29 acts to allow heat from the steam generator 15 via the contact flange 22 to dissipate evenly across the surface area of the ironing plate 13, as shown by arrows "a" in FIG. 3, and to avoid localised "hot spots" on the surface of the ironing plate 13 proximate the contact foot 25 of the contact flange 22 of the steam generator 15. Also, the width "r" of the recess 23 on which the contact flange 22 sits being greater than the width "d" of the contact foot 25/contact flange 22 means that heat transmitted from the steam generator is quickly and readily conducted away from the contact flange 22/contact foot 25, enhancing the uniform heat distribution across the ironing plate 13.

Figure 4:
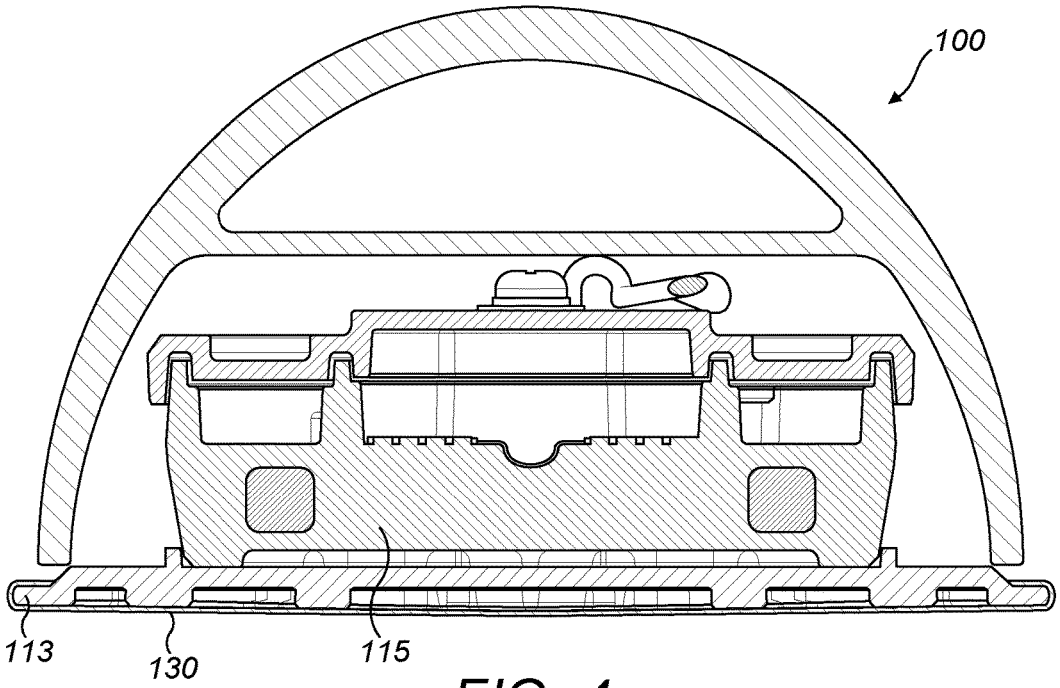
FIG. 4 shows a cross-sectional view similar to that of FIG. 2 but of a known steam iron configuration.
Figure 5:
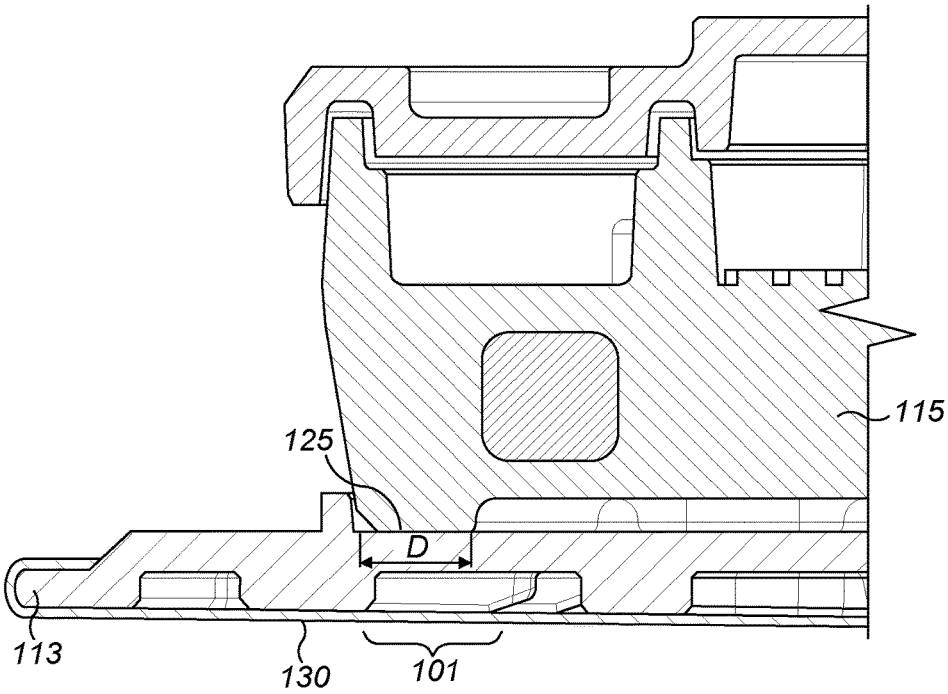
FIG. 5 shows an enlarged cross-sectional view of the circled portion of the known steam iron configuration shown in FIG. 4.

For comparison, a configuration of a known steam iron 100 is shown in FIGS. 4 and 5, and comprises a steam generator 115 coupled to an ironing plate 113. The base of the steam generator 115 includes a contact foot 125 that sits directly on the ironing plate 113. It can be seen that the contact foot 125 is formed closely with the main thermal mass of the steam generator 115 such that there is a substantially unrestricted and direct thermal path between the main thermal mass of the steam generator 115 and the contact foot 125. Furthermore, the contact foot 125 is relatively wide, as shown by width "D" in FIG. 5. In addition, the point at which the contact foot 125 is in contact with the ironing plate 113 is of substantially the same thickness as the majority of the width of the ironing plate 113. Therefore, there is no region of increased mass or thickness of material around the contact foot 125 to act as a thermal distribution area, as in the steam iron 10 of the present invention. As such, heat is readily transferred from the steam generator 115 to the ironing plate 113, and localised hot spots 101 are created at surface 130 of the ironing plate 113 corresponding to the position of the contact feet 125 of the steam generator 115. Also, the substantially unrestricted thermal path from the steam generator 115 to the ironing plate 113 means that large temperature fluctuations of the steam generator 115 quickly and significantly affect the ironing plate 113, and cause corresponding large temperature fluctuations in the ironing plate 113.

The above-described differences between the steam iron 10 of the invention and known steam iron 100 configuration of the effects of steam generator temperature fluctuations and localised hot spots, is also affected by the relative thermal masses of the steam generators 15, 115 and ironing plates 13, 113. Here, the "thermal mass" means the mass of material from which the component is formed that is subject to temperature changes during operation of the steam iron. That is, known steam irons 100 comprise a steam generator 115 with a significantly larger thermal mass than that of the ironing plate 113. Typically, the ratio of the steam generator thermal mass to the ironing plate thermal mass is around 2.5:1 to 3:1. This means that temperature changes in the steam generator 115 quickly and significantly affect the temperature of the ironing plate 113. In the steam iron 10 of the present invention however, the steam generator 15 and the ironing plate 13 are configured such that the ratio of the steam generator thermal mass to the ironing plate thermal mass is around 1:1 to 1.5:1. This further aids the thermal "damping" between the temperature fluctuations of the steam generator 15 (the active thermal mass) affecting the temperature of the ironing plate 13 (the passive thermal mass), meaning the temperature of the ironing plate 13 remains more stable during use. Also, the lower thermal mass of the steam generator 15 means that less thermal energy is stored in the steam generator 15 and so when the steam iron 10 is left static, the ironing plate 13 is not heated up as much as in known steam irons 100, avoiding excessive ironing plate temperatures towards or above the optimal temperature range.

An advantage of the configuration of steam iron 10 of the invention over known steam irons is that the improved heat distribution throughout the ironing plate 13 from heat received directly from the steam generator 15 avoids the need for an intermediate plate to be provided between the steam generator (i.e. the active source of the heat) and the ironing plate (i.e. the portion that comes into contact with the garments being ironed). In some known steam irons, an intermediate plate is required to help even out the heat distribution between the steam generator and the ironing plate to avoid hot spots. In such arrangements, the heat is initially spread out across the intermediate plate from the discrete contact points of the steam generator, and the more evenly distributed heat is then transferred to the ironing plate. Avoiding the need for an intermediate plate makes the construction of the steam iron of the invention simpler, making the construction process shorter and thereby reducing manufacturing and parts cost.

In the steam iron 10 of the invention, a user does not need to adjust the temperature of the iron to allow for different types of fabrics of garments being ironed. The steam generated and expelled by the iron performs the majority of the garment de-wrinkling function. As such, the ironing plate 13 can be maintained at a relatively constant temperature, such as below 145 degrees Celsius. The above-described features of the steam iron 10 of the invention thereby act to allow a relatively constant temperature ironing plate 13 regardless of the use of the steam iron 10. It also allows a more robust temperature control system to be used instead of the complex control algorithms required in known steam irons for adjusting the temperature of the steam generator 15 and ironing plate 13 to maintain the ironing plate 13 within optimal temperature limits, for the reasons explained below.

In the exemplary steam iron 10 of the invention, the steam generator temperature may be set to around 165 degrees Celsius for optimum functioning. Also, although the ironing plate 13 may be maintained at an optimum temperature of between 100-145 degrees Celsius, the ironing plate 13 needs to heat up to above 100 degrees Celsius because below this temperature, condensation of the steam generated can be detrimental to the steam iron performance. Therefore, a control scheme of the steam iron only allows steam activation to be enabled above an ironing plate temperature of 100 degrees Celsius.

An "iron ready time" is the time taken for the ironing plate 13 and steam generator 15 to reach an operational temperature when the steam iron 10 is first turned on. Usually this is the time for the ironing plate 13 and steam generator 15 to reach an operational temperature starting from room temperature. However, due to the configuration of the steam iron 10 of the invention described above, the iron ready time would be longer than for known steam irons 100 if a conventional control scheme or algorithm was to be used. In a conventional steam iron, the steam generator 115 is generally controlled to heat up until it reaches a maximum temperature as detected by the thermistor, at which point power is then cut so that the steam generator 115 cools down until it reaches a minimum threshold temperature. Normally, when starting up from cold, as thermal delays are more pronounced especially when the heating power is high, the initial temperature overshoot is high which results in the steam generator being raised to a much higher temperature than that in normal operation. When reaching the minimum temperature threshold, power is turned on again to heat the steam generator 115 to a lower maximum temperature, at which point the power is cut again and the steam generator 115 is heated until it reaches a further reduced maximum threshold temperature. The power is cut again and the steam generator 115 cools until it reaches the minimum threshold temperature, at which point power is supplied again. This cycle is repeated with the steam generator 115 being turned on again each time the steam generator 115 reaches the same minimum threshold temperature and the reducing maximum threshold temperatures aims to settle the steam generator 115 around an optimum operating temperature.

Figure 6:
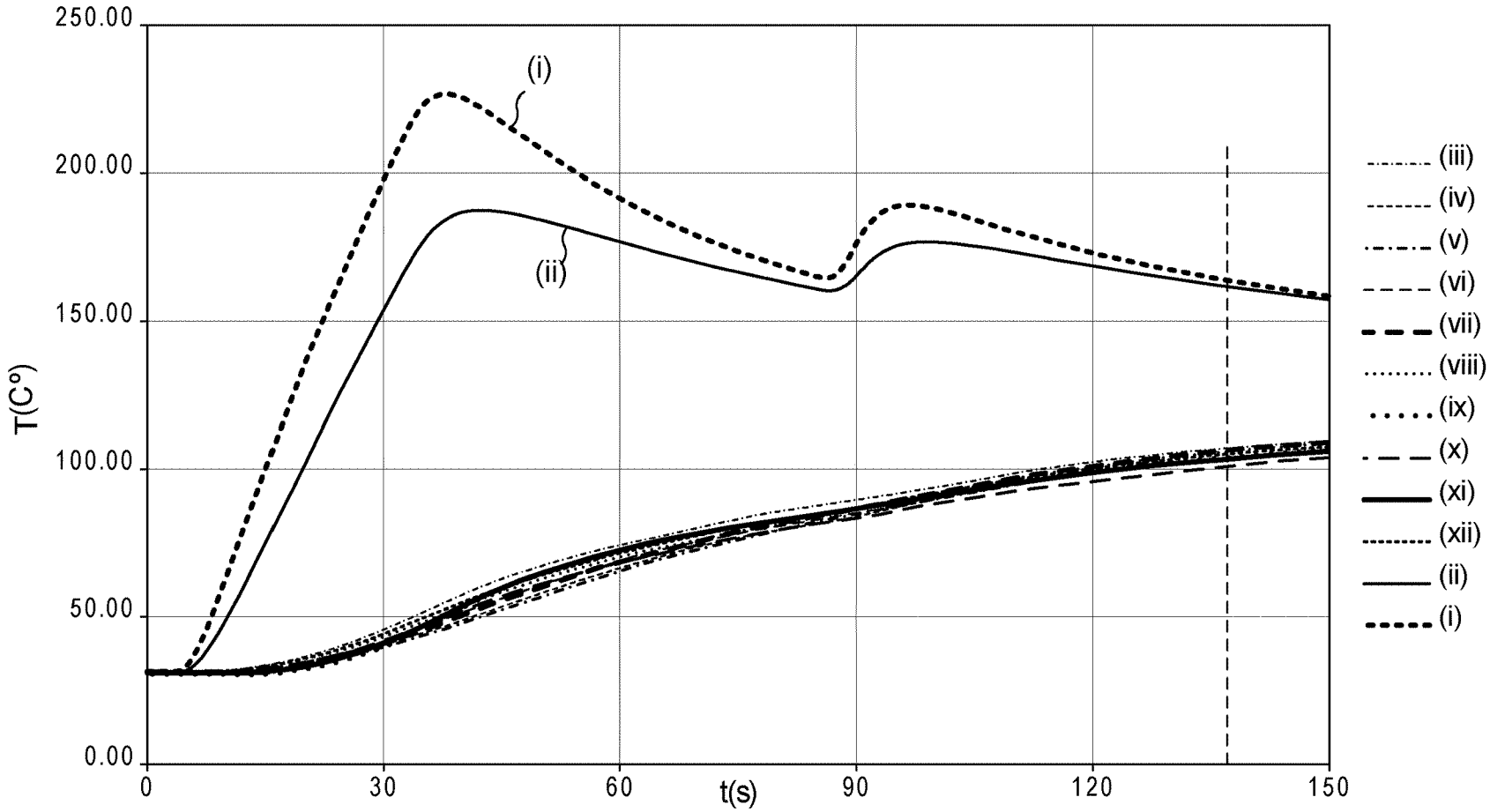
FIG. 6 shows a graph of temperature against time for a conventional steam iron control process.

FIG. 6 shows a graph of various temperature readings during an initial heat-up process, taken at points on a steam iron 10 configured according to that of the present invention, but being operated using a conventional control algorithm from a known steam iron 100. Line (i) represents the thermistor 20 reading representing the temperature of the steam generator 15. Line (ii) is the temperature at the thermal fuse. Lines (iii) to (xii) represent temperature readings at various points across the surface of the ironing plate 13 as the ironing plate 13 is passively heated by the steam generator 15. Such ironing plate temperature readings may optionally be detected by a thermistor 21 in or on the ironing plate. When the steam iron 10 is turned on, the steam generator 15 heats up from around 30 degrees Celsius to a first maximum temperature threshold, shown as around 225 degrees Celsius. The power is then cut and the steam generator 15 cools until it reaches its minimum temperature threshold, which it can be seen from FIG. 6 is around 165 degrees Celsius. The steam generator 15 is then powered again and heats up to a lower maximum threshold temperature of around 190 degrees Celsius before cooling to the lower threshold temperature. During this cycle, the temperature of the ironing plate 13 steadily increases until it reaches its minimum operating temperature of 100 degrees Celsius. In the process shown in FIG. 6, this takes nearly 140 seconds, an iron ready time of well over 2 minutes, as indicated by the vertical dashed line intersecting the x-axis at the point all ironing plate temperate plot lines pass above the 100 degrees Celsius line of the graph.

Figure 7:
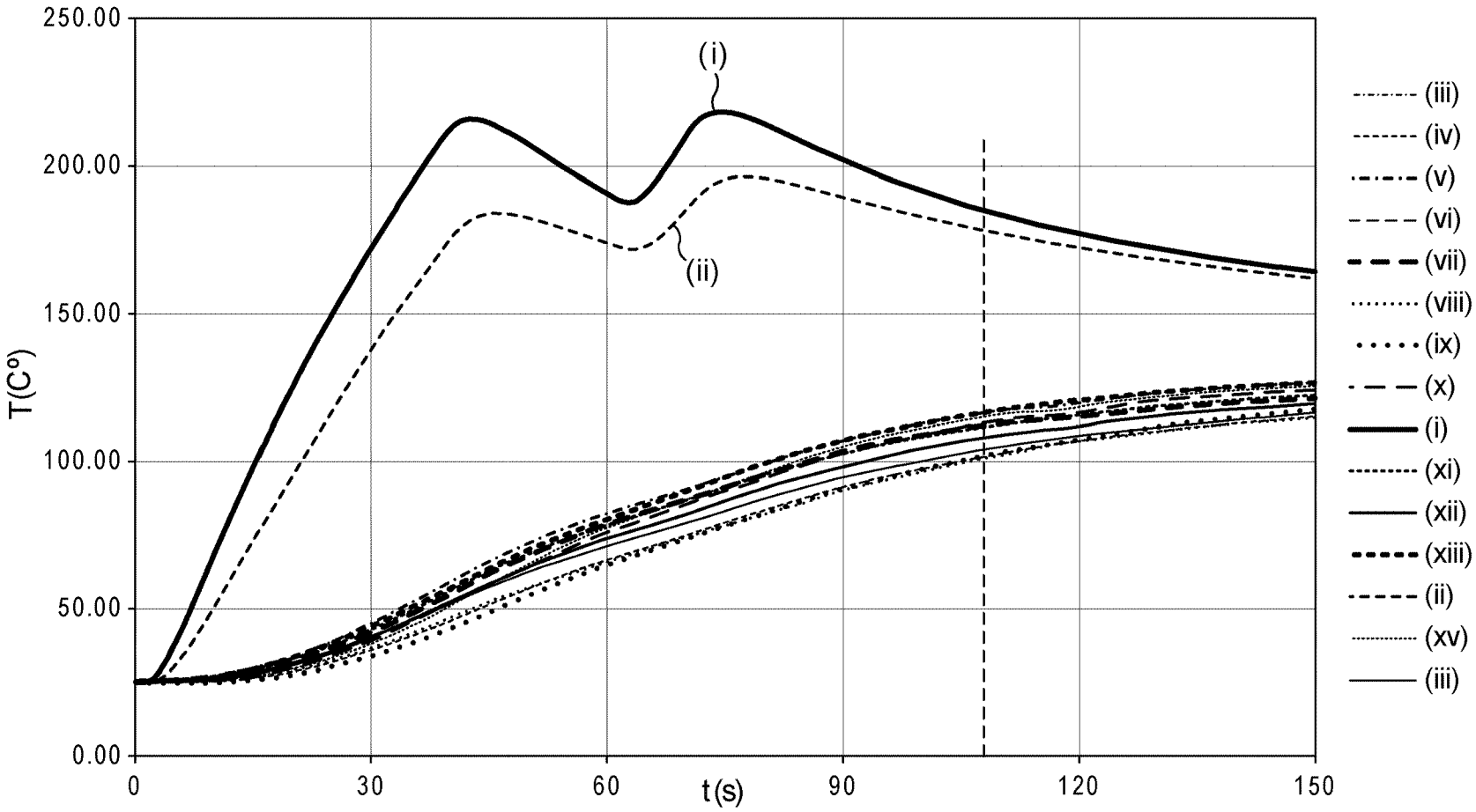
FIG. 7 shows a graph of temperature against time for a steam iron control process of the present invention.

In order to make a significantly quicker iron ready time than that when using a conventional control algorithm, embodiments may include a control scheme or algorithm for operating the steam iron 10 of the present invention. FIG. 7 shows a graph similar to that of FIG. 6, showing various temperature readings during an initial heat-up process, taken at points on a steam iron 10 configured according to that of the present invention. However, the graph of FIG. 7 shows the steam iron 10 being operated using a control algorithm of the present invention. Line (i) represents the thermistor 20 reading representing the temperature of the steam generator 15. Line (ii) is the temperature at the thermal fuse. Lines (iii) to (xv) represent temperature readings at various points across the surface of the ironing plate 13 as the ironing plate 13 is passively heated by the steam generator 15.

The control algorithm according to various embodiments may comprise heating the steam generator 15 to a higher temperature for the first one or more cycles upon initial power on of the steam iron 10 before the steam generator 15 is controlled to remain around a reduced temperature level. This is achieved by having a higher minimum temperature threshold during the initial heating cycles of the steam generator 15 than during the later operational cycles of the control algorithm. Referring to FIG. 7, the steam generator 15 is initially heated to a maximum temperature threshold of around 220 degrees Celsius at which point the heating is stopped and the steam generator 15 begins to cool. However, the initial minimum temperature threshold is set relatively high, at around 190 degrees Celsius, at which point the steam generator 15 is powered again. In the exemplary control algorithm represented by the graph of FIG. 7, the maximum temperature threshold remains the same for the second cycle and so the steam generator heats again to around 220 degrees Celsius before the power to the steam generator 15 is stopped again. By the time the steam generator 15 cools to the initial minimum temperature threshold, the ironing plate 13 has already reached the minimum operating temperature of 100 degrees Celsius. In the process shown in FIG. 7, as indicated by the vertical dashed line intersecting the x-axis at the point all ironing plate temperate plot lines pass above the 100 degrees Celsius line of the graph, this takes about 100 seconds, around 30 seconds quicker than if a conventional control algorithm was used. Therefore, maintaining the steam generator 15 at the elevated temperature for the initial one or more heating cycles during start up ensures quicker heat transfer to the ironing plate 13 and so a quicker iron ready time. Once the ironing plate has 13 reached the minimum operating temperature, the control algorithm uses a reduced minimum temperature threshold, and the maximum temperature threshold may also be correspondingly reduced so that the steam generator 15 is then maintained around an optimum operating temperature. Such optimum operating temperature may be around 165 degrees Celsius.

The exemplary control scheme described above allows the steam generator 15 to heat up to an elevated maximum temperature threshold for the first two heating cycles upon initial heating of the steam iron 10. However, the control scheme according to various embodiments is not intended to be limited to this number of initial heat cycles and the elevated maximum temperature threshold may be one or more than two cycles within the scope of the invention. Similarly, the initially elevated minimum temperature threshold of the steam generator 15 during the initial heating of the steam iron 10 may be present for more than one heat cycle within the scope of the invention. Furthermore, the control unit 18 of the steam iron 10 maybe configured to only reduce the initial maximum and/or minimum temperature thresholds of the initial heat cycles once a temperature of the ironing plate 13 reaches a pre-determined minimum operating temperature, which may be 100 degrees Celsius or may be another temperature value within the scope of the invention.

The control scheme according to various embodiments is not intended to be restricted to the specific temperature values given in the exemplary embodiment described above and other operating temperature ranges and threshold values are intended to be encompassed within the scope of the invention. In one exemplary embodiment, during the initial heat cycle(s), the steam generator 15 may be controlled to remain around 200 degrees Celsius, for example within 3 to 10 degrees either side of 200 degrees Celsius.

The control scheme according to various embodiments may optionally include a further function to provide an increased heating cycle of the steam generator 15 to an elevated heating temperature for one or more cycles before reverting to a lower operational temperature setting for the steam generator 15, if it is detected that the temperature of the steam generator 15 falls below a lower threshold value. For example, if the steam iron 10 is turned off and subsequently restarted, and in the off period the steam generator 15 falls below a (first) predetermined temperature, then a control algorithm may be activated to set the temperature at which the steam generator 15 is switched off in heating cycles to an elevated (second) predetermined temperature. The steam generator 15 may continue to be heated to this elevated (second) predetermined temperature for a predetermined number of cycles, or until the ironing plate reaches a threshold temperature, or for a set time period. Subsequently, the control algorithm may then set the temperature at which the steam generator 15 is switched off in heating cycles to a reduced (third) predetermined temperature for ongoing operation of the steam iron 10. In such an algorithm, the third predetermined temperature would be lower then the second predetermined temperature but higher than the first predetermined temperature. As an example, the first predetermined temperature may be 80 degrees Celsius. Yet further, the second predetermined temperature may be around 200 degrees Celsius, and/or the third predetermined temperature may be around 165 degrees Celsius.

In the exemplary embodiment of the steam iron 10 of the invention, the contact foot dimension "d" may be around 1-2 mm. Also, the thickness of the first and/or second fins 26, 27 of the contact flange 22 may be around 1-2 mm. However, the invention is not intended to be limited to these dimensions and other dimensions are intended to fall within the scope of the invention.

Figure 8:
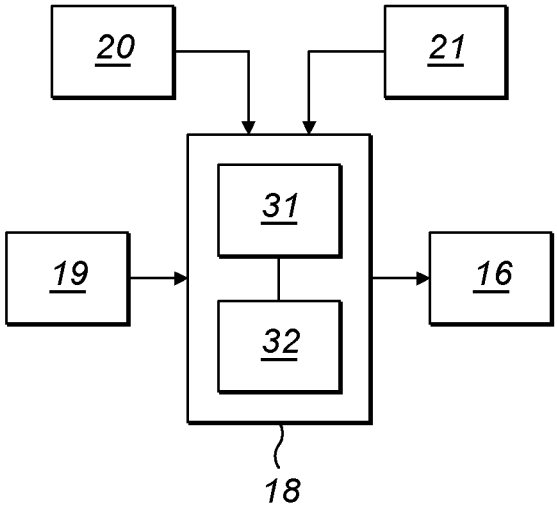
FIG. 8 schematically shows a control system for a steam iron of a first embodiment of the invention.

An overall control system of the steam iron 10 of the invention is shown schematically in FIG. 8. The controller 18 comprises a processor 31 and a memory unit 32. The memory unit 32 may store a number of control parameters for controlling the operation of the steam iron 10, such as various threshold temperatures for the steam generator 15 and optimum operating temperatures for the ironing plate 13 and/or the steam generator 15. The controller 18 is connected to the thermistor 20 of the steam generator 15 so as to receive signals relating to the temperature of the steam generator 15. Optionally, the controller 18 may receive signals relating to the temperature of the ironing plate 13. The controller is also connected to the motion/position sensor 19 in the body of the steam iron 10 to receive a signal dependent on the position or status (i.e. in use or not) of the steam iron 10. The controller 18 is connected to the heating element 16 of the steam generator 15 in order to be able to control operation of the heating element 16 in accordance with the control scheme described above.

The steam iron 10 of the invention, with the "damping" between heat fluctuations of the steam generator 15 and the passively heated ironing plate 13, is more tolerant of less stable water dosing rates from the water reservoir to the steam generator 15. That is, if a large amount of water is supplied to the steam generator 15, a large amount of steam is produced and the body of the steam generator 15 cools down significantly. However, the main thermal mass of the steam generator 15 is lower than in known steam irons 100 and so the steam generator 15 is more quickly able to be heated up according to the set operating temperature. Also, the restricted thermal path between the steam generator 15 and the ironing plate 13 means the briefly lowered temperature of the steam generator 15 does not cause such a drop in the temperature of the ironing plate 13. By reducing the mass of the steam generator 15, the power on time of the heating element 16 of the steam generator 15 is reduced to reach a pre-determined temperature. Also, less heat is stored in the steam generator 15. By also increasing the relative mass of the ironing plate 13, the heat energy transferred to the ironing plate 13 results in lower temperature increases of the ironing plate 13.

Although the steam iron 10 of the invention is described as having an integral water reservoir within the body 11 of the steam iron 10, the invention is not intended to be limited to such a configuration and is intended to also encompass embodiments of steam iron which have a remote water reservoir. Such a steam iron (not shown) may comprise the steam generator within the body of the iron which is supplied with water via a water hose from a separate reservoir contained in a static base portion. The water transfer mechanism may comprise an electric pump in the body of the steam iron or in the base portion. In use, the base remains fixed and only the steam iron portion is moved across the garments by a user. Although such an alternative embodiment has a more complicated construction and occupies more space, it has the advantage that the user-moveable portion of the steam iron is lighter and easier to manipulate since it does not contain the weight of the water supply.

Although the steam iron 10 of the invention is described as having one thermistor 21 on the ironing plate 13, the invention is not limited to this number and the ironing plate 13 may comprise a plurality of thermistors 21 connected to the controller 18, to detect temperatures at different points on the ironing plate 13.

Although the exemplary steam iron 10 of the invention includes a contact flange 22 comprising a substantially horizontal first fin 26 and a substantially vertical second fin 27, the invention is not intended to be limited to this configuration. In particular, the second fin 27 may extend downwards from the first fin 26 at an angle to the vertical. Yet further, the invention is not intended to be limited to a contact flange 22 comprising an angled configuration between two separate flange portions such as the fins 26, 27 shown and described. In an alternative embodiment within the scope of the invention, the contact flange may comprise a continuous curved shape, or a straight section transitioning into a curved shape, whilst still providing the thermal restriction between the steam generator 15 and the ironing plate 13.

In the exemplary embodiment of steam iron 10 shown, the main body portion 15*a* of the steam generator 15 comprises the majority of the mass of the steam generator 15, with the peripheral flange 22 portion of the steam generator 15 accounting for a much smaller proportion of the total mass of the steam generator 15. In the exemplary embodiment, the mass of the main body portion 15*a* of the steam generator may comprise between 75% to 95% of the total mass of the steam generator 15, and may be greater than 85% of the of the total mass of the steam generator 15, and yet further may be greater than 90% of the total mass of the steam generator 15.

The ironing plate 13 of the steam iron 10 of the invention shown and described is thicker in the region of the thermal distribution area 29 than over the rest of the width of the ironing plate 13. This helps provide optimum heat transfer from the contact flange 22 across the ironing plate 13. Also, the recess 23 of the ironing plate 13 upon which the contact flange 22 sits shown as described as being wider than the contact flange 22, shown by dimension "r" indicated in FIG. 2 being wider than dimensions "d". Advantageously, the dimension "r" is at least 1 mm greater than the dimension "d". In particular, as the exact widths "r" and "d" may vary across the length and cross-section of the steam iron 10, the average width "r" of the recess 23 over the whole of the ironing plate 13 is preferably at least 1 mm greater than the average width "d" across the whole of the steam generator contact flange 22.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A steam iron comprising:

a steam generator comprising a main body portion including an electrical heating element to heat the steam generator and a flange integrally formed with the main body portion and spaced therefrom; and an ironing plate thermally coupled to the steam generator and configured to be passively heated by conduction of heat from the steam generator, wherein the flange is in contact with a thermal distribution area integrally formed with the ironing plate to thermally couple the main body portion of the steam generator to the ironing plate via an indirect thermal path through the flange, the thermal distribution area being configured to dissipate heat evenly across an ironing surface of the ironing plate, the flange and the thermal distribution area being configured to space the main body portion of the steam generator from the ironing plate to form an air gap between the main body portion of the steam generator and the ironing plate, and to restrict the conduction of heat from the main body portion of the steam generator to the ironing plate, wherein the thermal distribution area of the ironing plate comprises an area of increased thickness in a region where the flange contacts the ironing plate to enhance thermal distribution of conducted heat from the flange through the ironing plate, and wherein the flange comprises a first portion extending in a first direction from the main body portion of the steam generator, and a second portion extending from the first portion such that a gap is defined between the main body portion of the steam generator and the second portion of the flange.

2. The steam iron according to claim 1, wherein the flange is between 1-3 mm thick.

3. The steam iron according to claim 1, wherein the width of the flange at the contact point between the flange and the ironing plate is between 1-3 mm over at least 50% of the contact area.

4. A steam iron comprising:

a steam generator comprising a main body portion including an electrical heating element to heat the steam generator and a flange integrally formed with the main body portion and spaced therefrom; and an ironing plate thermally coupled to the steam generator and configured to be passively heated by conduction of heat from the steam generator, wherein the flange is in contact with a thermal distribution area integrally formed with the ironing plate to thermally couple the main body portion of the steam generator to the ironing plate via an indirect thermal path through the flange, the thermal distribution area being configured to dissipate heat evenly across an ironing surface of the ironing plate, the flange and the thermal distribution area being configured to space the main body portion of the steam generator from the ironing plate to form an air gap between the main body portion of the steam generator and the ironing plate, and to restrict the conduction of heat from the main body portion of the steam generator to the ironing plate, wherein the thermal distribution area of the ironing plate comprises an area of increased thickness in a region where the flange contacts the ironing plate to enhance thermal distribution of conducted heat from the flange through the ironing plate, and wherein the steam generator is primarily coupled to the ironing plate by the flange and the remainder of the steam generator is spaced from the ironing plate over at least 75% of the adjacent surface of the steam generator.

5. The steam iron according to claim 4, wherein the flange comprises a first portion extending in a first direction from the main body portion of the steam generator, and a second portion extending from the first portion such that a gap is defined between the main body portion of the steam generator and the second portion of the flange.

6. The steam iron according to claim 4, wherein the flange is between 1-3 mm thick.

7. The steam iron according to claim 4, wherein the width of the flange at the contact point between the flange and the ironing plate is between 1-3 mm over at least 50% of the contact area.

8. A steam iron comprising:

a steam generator comprising a main body portion including an electrical heating element to heat the steam generator and a flange integrally formed with the main body portion and spaced therefrom; and an ironing plate thermally coupled to the steam generator and configured to be passively heated by conduction of heat from the steam generator, wherein the flange is in contact with a thermal distribution area integrally formed with the ironing plate to thermally couple the main body portion of the steam generator to the ironing plate via an indirect thermal path through the flange, the thermal distribution area being configured to dissipate heat evenly across an ironing surface of the ironing plate, the flange and the thermal distribution area being configured to space the main body portion of the steam generator from the ironing plate to form an air gap between the main body portion of the steam generator and the ironing plate, and to restrict the conduction of heat from the main body portion of the steam generator to the ironing plate, wherein the thermal distribution area of the ironing plate comprises an area of increased thickness in a region where the flange contacts the ironing plate to enhance thermal distribution of conducted heat from the flange through the ironing plate, and wherein the ratio of the mass of the steam generator to the mass of the ironing plate is between 1:1 and 1.5:1.

9. The steam iron according to claim 8, wherein the flange comprises a first portion extending in a first direction from the main body portion of the steam generator, and a second portion extending from the first portion such that a gap is defined between the main body portion of the steam generator and the second portion of the flange.

10. The steam iron according to claim 8, wherein the flange is between 1-3 mm thick.

11. The steam iron according to claim 8, wherein the width of the flange at the contact point between the flange and the ironing plate is between 1-3 mm over at least 50% of the contact area.

12. The steam iron according to claim 1, further comprising a controller to control operation of the steam iron, wherein the controller is configured to perform a first heating operation upon initial heating of the steam iron, and perform a second heating operation during subsequent operation of the steam iron, wherein the first heating operation comprises heating the steam generator to a higher temperature range than with the second heating operation.

13. The steam iron according to claim 12, wherein the first heating operation comprises heating the steam generator to remain above a first minimum predetermined temperature, and the second heating operation comprises heating the steam generator to remain above a second minimum predetermined temperature, wherein the first minimum temperature is higher than the second minimum temperature.

14. The steam iron according to claim 12, wherein during the second heating operation the steam generator is maintained at a temperature between 140 and 200 degrees Celsius.

15. The steam iron according to claim 12, wherein the controller is configured to perform the first heating operation until the ironing plate reaches a predetermined minimum operating temperature.

16. The steam iron according to claim 15, wherein the minimum operating temperature is 100 degrees Celsius.

17. The steam iron according to claim 12, wherein the controller is configured to control the temperature of the steam generator such that the temperature of the ironing plate is maintained between 100 degrees Celsius and 145 degrees Celsius.

18. The steam iron according to claim 12, further comprising at least one of a motion sensor and an orientation sensor connected to the controller, and the controller is configured to control the heating of the steam generator in dependence upon at least one parameter of ironing direction, speed and iron orientation as detected by the at least one sensor.

19. The steam iron according to claim 12, wherein the controller is configured to control operation of the steam generator such that if the temperature of the steam generator falls below a first predetermined value, then the controller sets a steam generator heater switch OFF value for an initial heating cycle of the steam iron to a second predetermined value, whereas during subsequent ironing operation the steam generator is operated at a third predetermined temperature value, the third predetermined temperature value being higher than the first predetermined temperature value and lower than the second predetermined temperature value.

20. A steam iron comprising:

a steam generator that comprises a main body portion including an electrical heating element to heat the steam generator;

an ironing plate; and a flange integrally formed with one of (i) the ironing plate, or (ii) both the main body portion of the steam generator and the ironing plate and spaced therefrom, wherein the ironing plate is thermally coupled to the steam generator and configured to be passively heated by conduction of heat from the steam generator, and wherein the flange is in contact with a thermal distribution area integrally formed with the ironing plate to thermally couple the main body portion of the steam generator to the ironing plate via an indirect thermal path through the flange, the thermal distribution area being configured to dissipate heat evenly across an ironing surface of the ironing plate, the flange and the thermal distribution area being configured to space the main body portion of the steam generator from the ironing plate to form an air gap between the main body portion of the steam generator and the ironing plate, and to restrict the conduction of heat from the main body portion of the steam generator to the ironing plate, and wherein the thermal distribution area of the ironing plate comprises an area of increased thickness in a region where the flange contacts the ironing plate to enhance thermal distribution of conducted heat from the flange through the ironing plate.

* * * * *